United States Patent [19]

Hornbeck

[11] 4,295,309

[45] Oct. 20, 1981

[54] LOAD SUPPORT STRUCTURE

[75] Inventor: Clarence J. Hornbeck, Allentown, Pa.

[73] Assignee: Follett Corporation, Easton, Pa.

[21] Appl. No.: 80,885

[22] Filed: Oct. 1, 1979

[51] Int. Cl.[3] ..... E04C 1/26

[52] U.S. Cl. ..... 52/309.7; 52/309.9; 312/214

[58] Field of Search ..... 52/309.7, 309.9, 222, 52/785, 789, 790, 813, 822; 220/66, 68; 312/295, 214

[56] References Cited

U.S. PATENT DOCUMENTS 66,540 7/1867 Wappich ..... 220/66
2,089,865 8/1937 Voss ..... 52/222
4,030,265 6/1977 Allgood ..... 52/339
4,159,681 7/1979 Vandament ..... 52/309.7

*Primary Examiner*—James L. Ridgill, Jr.
*Attorney, Agent, or Firm*—Seidel, Gonda, Goldhammer and Panitch

[57] ABSTRACT

The load support structure includes a compression member joined adjacent its ends to the end portions of a tension member. A foam plastic is disposed between said members and bonded to the juxtaposed surfaces of said members so that force applied to one of said members will be resisted by the shear and tension modulus of the foam plastic whereby the load support structure can support increased loads. The support structure may be the floor in a storage housing.

20 Claims, 8 Drawing Figures

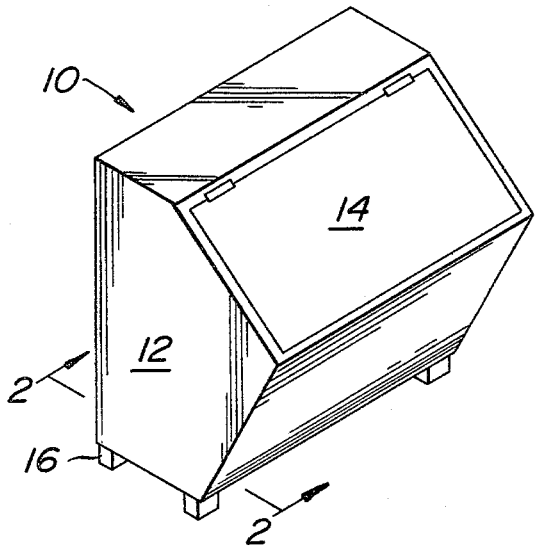
FIG. 1
FIG. 2
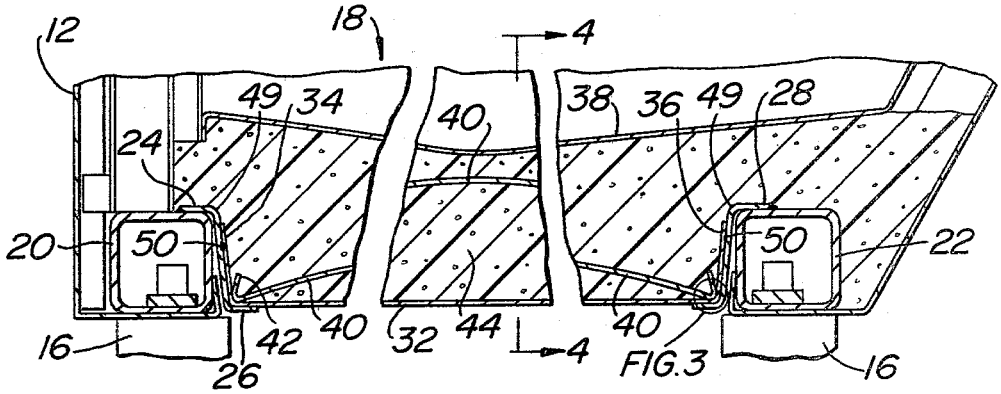
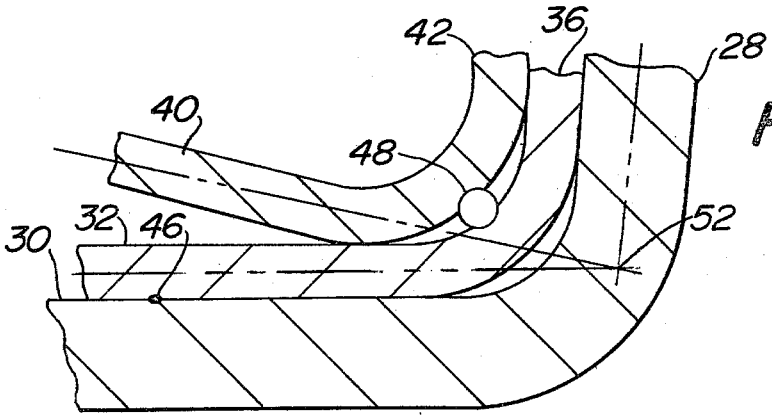
FIG. 3

| | |
|---|---|
| **COMPRESSION MEMBER** | |
| CONTOUR RADIUS, R, INCHES | 80 |
| THICKNESS, t, INCHES | TO BE VARIED |
| YIELD STRENGTH, $\sigma_y$, POUNDS PER SQUARE INCH | 30,000 |
| RIGIDITY OF MATERIAL, E, POUNDS PER SQ. INCH | 30,000,000 |
| **ELASTIC FILLER** | |
| TOTAL THICKNESS, $h_1 + h_2$, INCHES | 4.04 |
| RIGIDITY OF MATERIAL, $E_f$, POUNDS PER SQ. INCH | 1000 |

LOAD SUPPORT STRUCTURE

BACKGROUND

In U.S. Pat. No. 4,030,265, there is disclosed an arch beam comprised of a low modulus filler between a compression member and a tension member. Thus, the arch beam in said patent bears a superficial resemblance to the present invention. In said patent, the resistance of the compression member is increased by utilizing the compression strength of the low modulus filler. In said patent, the support points 20 and 21 are spaced apart by a distance which is smaller than the distance between the focus points. In said patent, reaction blocks 18 and 19 are utilized to distribute stress concentration from the reaction forces at the support points. The present invention is directed to a different class of structures from that disclosed in said patent.

SUMMARY OF THE INVENTION

The load support structure includes a load bearing face sheet, an opposed face sheet functioning as a tension member, and a contoured compression member therebetween. Support means are focally joined with the end portion of the compression and tension members, whereby they may react to face loads with minimum residual bending moments. A foam plastic, filling all internal space, is bonded to all surfaces contacted thereby. There are thereby established elastic foundations situated above and below the compression member which resist bending motions of said member. The upper foundation also provides a distributive connection between the loaded face sheet and other members. Bonding of the foam at all interfaces enables the shear, tension, and compression moduli of the foam, as well as the stiffness of the face sheet and tension member, to increase the resistance of the foundations to bending motions of the compression member. The resulting constraint of bending motions of the compression member allows increased loading on the face sheet.

In an alternate construction the load support structure does not include the load bearing face sheet nor the foam plastic filler above the compression member. Loads are applied directly to the compression member. The elastic foundation below the compression member functions as described above.

An operative embodiment of the present invention incorporates the load support structure as the bottom wall of a storage container such as an ice bin. The compression member and tension member are preferably provided with a rough zinc coating so as to provide a surface to which the foam will readily bond. If the foam is not bonded to the juxtaposed surfaces of the compression members, tension member and face sheet, only the compression modulus of the foam may be utilized. When the foam is bonded to the juxtaposed surfaces of the compression and tension members and face sheet, the shear, tension and compression moduli of the foam can be reliably utilized which in turn provides for an outstanding difference in the face loading necessary to produce a failure of the compression member. Thus, as compared with the arch beam disclosed in said patent, the present invention may sustain greater loads per weight of the compression member.

It is an object of the present invention to provide a load support structure which will withstand greater loads while at the same time is structurally interrelated in a manner whereby it may be inexpensively constructed.

It is another object of the present invention to provide a novel load support structure wherein a compression member, a tension member, and face sheet are joined to foam therebetween in a manner so as to utilize the shear, tension and compression modulus for resisting bending loads.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a storage container such as an ice bin.

FIG. 2 is a sectional view taken along the line 2—2 in FIG. 1.

FIG. 3 is an enlarged detail view of the encircled components in FIG. 2.

Figure 4:
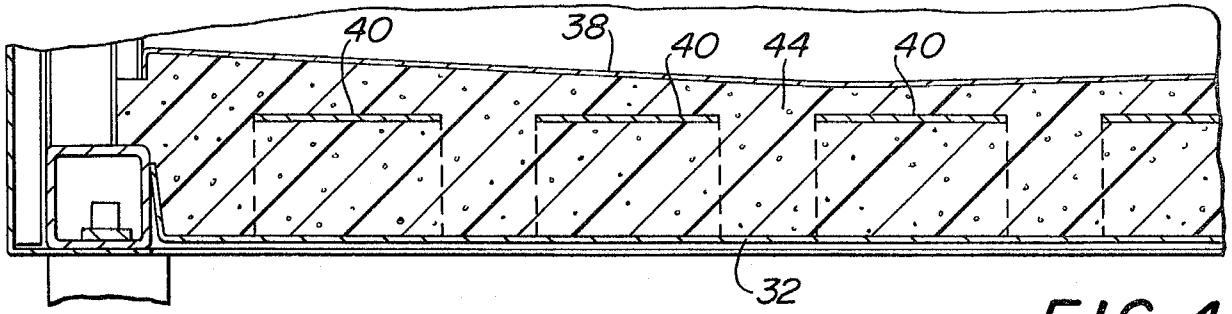
FIG. 4 is a sectional view taken along the line 4—4 in FIG. 2.

Referring to the drawings in detail, wherein like numerals indicate like elements, for purposes of illustrating one environment for the present invention, there is illustrated a storage container in the form of an ice bin designated generally as 10. The ice bin 10 includes a housing 12 having an access door 14 pivotably secured thereto. The housing 12 is mounted on legs 16.

Referring to FIG. 2, there is illustrated the bottom wall 18 of the housing 12. Wall 18 is supported by members 20 and 22 which are preferably tubular in section. Each of the members 20 and 22 is supported by a separate pair of the legs 16. The members 20, 22 may be positioned to support the wall 18 at a location above or below the elevation of the bottom surface of the wall 18.

A metal hanger strap 24 has its upper end welded to a top surface of the member 20. The hanger strap 24 extends downwardly to a horizontally disposed flange 26. A similar hanger strap 28 has its upper end welded to a top surface on member 22 and extends downwardly to a horizontally disposed flange 30. The flanges 26 and 30 extend toward one another.

Figure 5:
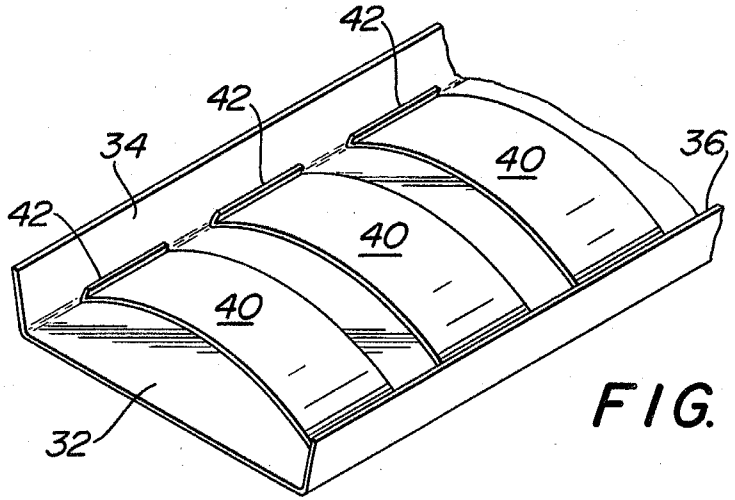
FIG. 5 is a partial perspective view of the compression and tension members.

A tension member 32 which may be a flat or curved has upturned end portions 34 and 36. See FIGS. 2 and 5. The wall 18 is defined at its lowermost surface by the member 32 and at its uppermost suface by a face sheet 38. Sheet 38 may be flat or sloped as shown in FIGS. 2 and 4. One elongated compression member or a plurality of discrete compression members 40 are disposed between the tension member 32 and the face sheet 38. See FIGS. 4 and 5. Each of the compression members 40 has an upturned end portion 42 at each end thereof. The space between adjacent compression members 40 is sufficient to allow circulation of a filler when injected into said space. A suitable dimension for such space is about one-half the width of the compression members 40. Such circulation space may be attained by holes in members 40. An elastic, low modulus insulation filler 44 such as foam urethane is foamed in situ to fill all internal space.

In order to obtain a high strength bond between the foam plastic filler 44 and surfaces in contact therewith, the bottom surface of face sheet 38, the opposite surfaces of the compression members 40 and the top surface of tension member 32 are suitably prepared. For example, the surface preparation may include chemical washing, zinc coating, sand blasting, special paints, adhesive coating, or the like.

The end portions of the compression member 40 and tension member 32 are mechanically coupled together in a manner so as to minimize residual bending moments. Referring to FIG. 3, one inexpensive manner for joining the members 32, 40 is to provide bent end portions. Flange 30 is spot welded at point 46 to the tension member 32. Tension member 32 is tack welded to the compression member 40 at welds 48. The upper end portions 34 and 36 are spot welded at their upper ends at 50 to the hangers 24 and 28 respectively. Hangers 24 and 28 provide elastic hinges at 49 due to the right angled construction.

As shown in FIG. 3, the portions of members 32 and 40 adjacent the weld 48 have center lines which intersect at focal point 52. The center line of the hanger 28 also intersects focal point 52. Since the center lines intersect point 52, and force vectors coincide with center lines, there is a minimum of residual bending moments. While it is not necessary for the center lines to intersect exactly at focal point 52, a minor discrepancy is easily accomodated by the strength of the hanger 28.

The compression members 40 may be arches as shown or may have other configurations appropriate to the loading pattern which results in an apex. The apex of the compression members 40 is preferably as near the face sheet 38 as manufacturing tolerances allow. In an operative embodiment of the present invention, zinc coated mild steel members 32 and 40 had a thickness of 0.030 inch, zinc coated mild steel hangers 24, 28 had a thickness of 0.060 inch, and chemically washed stainless steel face sheet 38 had a thickness of 0.024 inches. The span between the hangers 24, 28 in the operative embodiment was 43 inches. The compression members 40 had a width of 3 inches. The space between adjacent compression members 40 was 1.5 inches. The filler 44 was urethane foam weighing three pounds per cubic foot. Members 40 are rectangular in section with a thickness of about 1/116 the distance between sheet 38 and member 32 when the rigidity of the filler 44 is 1/16,000 the rigidity of members 40. The maximum thickness of member 40 which would be applicable is about 1/16th the distance from face sheet 38 to tension member 32. This maximum thickness relates to the ratio of the rigidity of the filler 44 to the rigidity of member 40. The said maximum thickness is linearly proportional to the cube root of said ratio. These dimensions and materials may be varied as desired.

While urethane foam is the preferred filler 44, other fillers may be used as foam plastic with reinforcing fibers of glass or carbon, wood chips in a binding matrix, metal particles in a binding matrix, solid polymeric plastics, etc.

Figure 6:
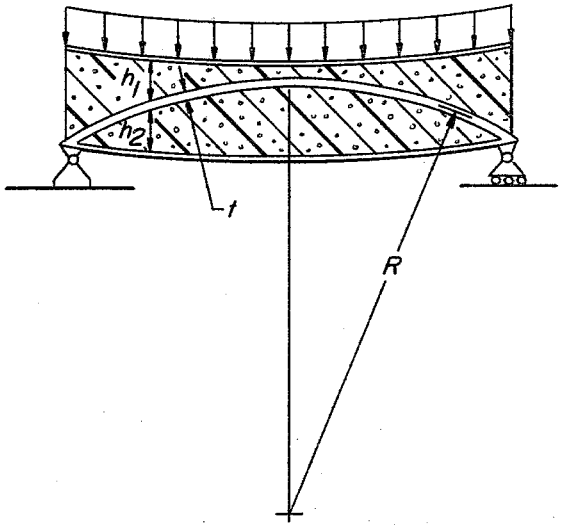
FIG. 6 is a diagramatic illustration of one design, a rectangular sectioned compression member of arcuate contour and uniform loading pressure applied to the face sheet.
Figure 7:
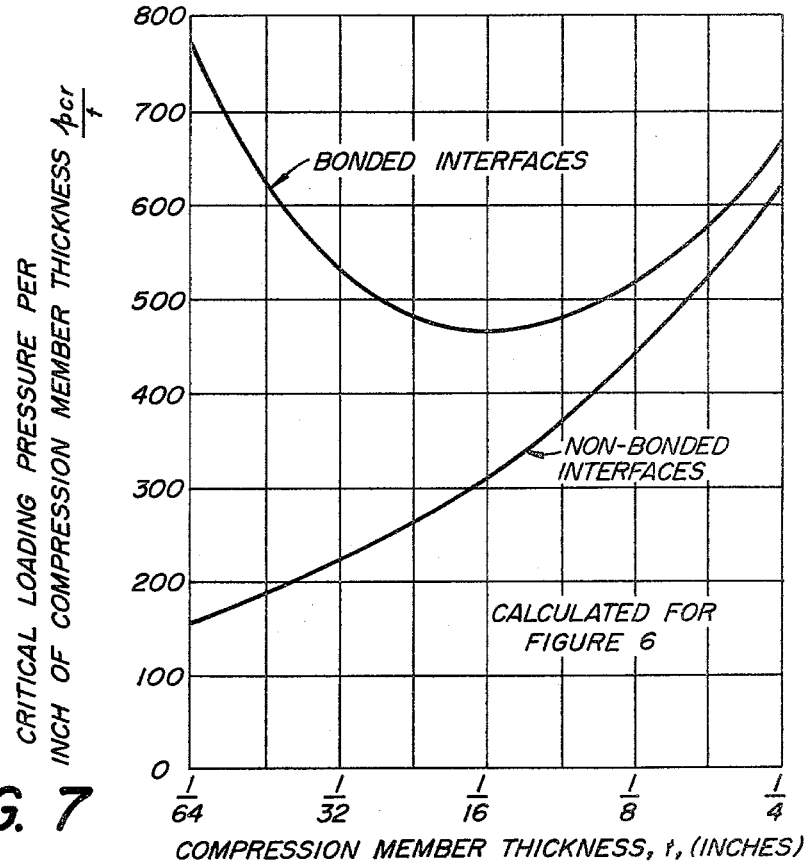
FIG. 7 is a graph, calculated for FIG. 6, of critical loading pressure versus thickness and comparing bonded interfaces of the present invention with non-bonded interfaces.
Figure 8:
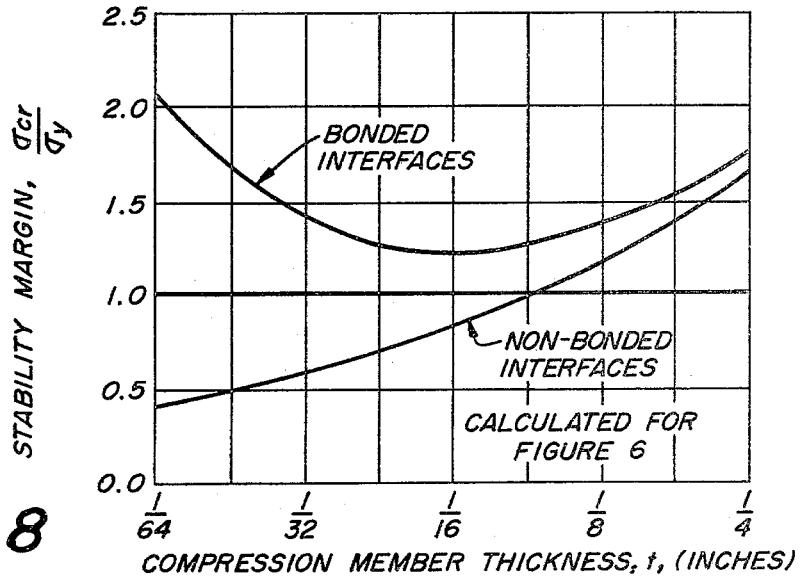
FIG. 8 is a similar graph of stability margin versus thickness.

FIGS. 7 and 8 dramatically indicate the unique results of the present invention. In FIG. 7, there is plotted a graph of critical loading pressure calculated for the design illustrated in FIG. 6 for uniform face loading to produce elastic buckling per weight of compression member versus thickness of the compression member for the bonded foam filler 44 of the present invention and for the same structure where the members are not bonded to the filler 44. As shown in FIG. 7, there is little difference in this example between the bonded and the non-bonded interfaces when the compression member has a thickness in excess of about $\frac{1}{4}$ inch. However, as the thickness of the compression member is reduced, the bonded interfaces of the present invention resists larger buckling loads on the order of a magnitude of 4 to 5 as compared with the non-bonded interfaces.

FIG. 8 is a graph of stability margin (ratio of critical stress to yield stress) calculated for uniform face loading versus thickness of the compression member in inches. With bonded interfaces, all thickness have a stability margin greater than one. With non-bonded interfaces, only thickness above $\frac{1}{8}$ inch have a stability margin greater than one.

If the loading pattern in FIG. 6 were changed, the compression member would have bending stresses even with the smallest amount of load due to the arcuate contour, whereby the concept of elastic instability would not have significant meaning. If the loading were at a small zone at midspan, the bonded interfaces would reduce bending stress in the compression members 40 by reducing bending motions. In a non-bonded system, the compression member would lose contact with the filler 44 over portions of the span. This lack of constraint would result in increased bending stress in the compression member. For equal stress in the compression members, the bonded interfaces of the present invention cause the load support structure to sustain greater face loads as compared to the non-bonded surfaces. This is very important since all real structures have bending stresses caused by manufacturing tolerances and off-design loading patterns.

Though the above remarks concerning FIGS. 7 and 8 strictly apply only to the design example of FIG. 6, it will be understood that this example serves to illustrate the properties of a broad family of designs having widely varying dimensions and materials. This family is characterized by the rigidizing effects of bonding the filler 44 to all surfaces contacted as described above, and by the reduction in required bending stiffness of the compression member made possibly thereby. This family is also characterized by relatively small deflections of the loaded face sheet for structures of such cost and weight for the same reasons. FIGS. 7 and 8 also illustrate that this family does not extend indefinitely, and is limited by designs having relatively great bending stiffness of the compression member in relation to the resistance to bending motions provided by the two elastic foundations.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising a housing having at least one wall for resisting forces within the housing, said wall comprising a tension member on an outer surface thereof and at least one arched compression member inwardly thereof, said compression member being juxtaposed to the tension member and spaced therefrom except for the end portions thereof, said members having curved end portions adjacent each free end thereof, the curved end portions of said members being welded together, each free end of said compression member being spaced from the adjacent free end of said tension member, a low modulous filler between said members and bonded to the juxtaposed surface of each of said members so that force supplied to one of said members will be resisted in part by the shear and tension strength of the filler, and means for supporting said members on said housing at or adjacent the focal points for minimizing residual bending moments including at least one hanger on opposite sides of the end portions of said tension member, each hanger having one end fixedly anchored to a support on said housing and which is stationary with respect to said wall, each hanger having its other end fixedly secured to the tension member at a location spaced from the ends of the tension member.

2. Apparatus in accordance with claim 1 wherein said wall is the bottom wall of said housing, a concave face sheet overlying and bonded to said filler, said face sheet being exposed to the interior of said housing.

3. Apparatus in accordance with claim 1 wherein said compression member has a thickness not greater than about 1/16 of an inch.

4. A load support structure in accordance with claim 1 wherein a plurality of said compression members are disposed side-by-side and spaced from one another, the tension member being wider than the combined width of the compression members, each compression member being secured at its end portions to juxtaposed end portions of the tension member, said bonded filler being between the compression members as well as between each compression member and the tension member.

5. A load support structure in accordance with claim 4 wherein said filler also overlies the upper surface of said compression members and is bonded to the compression members and to a face sheet above said compression members, the filler above the compression members being integral in one piece wih the filler beneath the compressions members.

6. A load support structure comprising a face sheet, a tension member, an arched compression member between said face sheet and the tension member and spaced from the tension member except for the end portions thereof, each end portion of said compression member being joined to said tension member adjacent to but spaced from the latter's ends in a manner so that forces transmitted to the tension member are not limited by the strength of the joint, said members having surfaces prepared to facilitate adhesion of a filler a low modulus filler occupying all internal space and bonded to said prepared surfaces of said members and face sheet so that load applied to said face sheet will be resisted in part by the shear, tension and compression strength of the filler, and means spaced from said face sheet for supporting said members at the focal points for minimizing residual bending moments.

7. A load support structure in accordance with claim 6 wherein a plurality of said compression members are disposed side-by-side and spaced from one another, the tension member being wider than the combined width of the compression members, each compression member being joined at its end portions to the tension member adjacent its ends, said bonded filler being between the compression members as well as between each compression member and the tension member, said filler also overlying the upper surface of said compression members and being bonded thereto, the filler above the compression members being integral in one piece with the filler beneath the compression members and being bonded to said face sheet.

8. A load support structure in accordance with claim 6 wherein the compression member is rectangular in section and has a maximum thickness of about one twentieth (1/20) the distance between the face sheet and tension member when the rigidity of the filler material is one thirty thousandth (1/30,000) of the compression member material, said maximum thickness being linearly proportional to the cube root of the rigidity of the filler material.

9. A load support structure in accordance with claim 6 wherein the sectional shape of the compression member is other than rectangular while having bending stiffness corresponding to the bending stiffness of a rectangular sectioned compression member whose maximum thickness is about one twentieth (1/20) the distance between the face sheet and tension member when the rigidity of the filler material is one thirty thousandth (1/30,000) the rigidity of the compression member material, said maximum thickness being linearly proportional to the cube root of the rigidity of the filler material.

10. A load support structure in accordance with claim 6 wherein the support means presents only small resistance to motions of the focal points caused by temperature change or deflections of said structure under load.

11. A load support structure in accordance with claim 6 including at least one hanger on opposite sides of the end portions of said tension member, having its upper end anchored to a support, each hanger having its lower end fixedly secured to the tension member, said hangers and support constituting said supporting means.

12. A load support structure in accordance with claim 6 wherein said tension member has upturned ends.

13. A load support structure in accordance with claim 6 wherein the span of the tension member is straight.

14. A load support structure in accordance with claim 6 wherein the span of the tension member is contoured, the concave side of said contour being internal to the structure.

15. A load support structure in accordance with claim 6 wherein the load bearing face sheet is contoured to accomodate the load environment.

16. A load support structure in accordance with claim 6 wherein said low modulus filler is bonded in situ to prepared surfaces of said members.

17. A load support structure in accordance with claim 6 resistant to the transmission of heat due to the absence of conductive members joining the face sheet and other members and due to the insulating property of the filler material.

18. A load support structure in accordance with claim 6 resistant to the transmission of sound due to the absence of conductive members joining the face sheet and other members, due to the rigidity of the structure to applied face loading, and due to the sound deadening property of the filler material.

19. A load support structure in accordance with claim 6 wherein bending stresses in the compression and tension members are confined to small zones adjacent the focal point by reinforcement, said reinforcements cooperating with the support means to limit the extent and degree of said stresses.

20. A load support structure in accordance with claim 19 wherein the compression member is so contoured that, with design pattern loading applied to the face sheet, bending stress in the compression member results only from manufacturing tolerances, excepting said small zones.

* * * * *